US005176266A

United States Patent [19]

Gillet

[11] Patent Number: 5,176,266

[45] Date of Patent: Jan. 5, 1993

[54] FIXING SYSTEM USING CABLES OR RODS

[75] Inventor: Guy Gillet, Vineuil, France

[73] Assignee: Mobile Cables System, Paris, France

[21] Appl. No.: 760,053

[22] Filed: Oct. 23, 1991

Related U.S. Application Data

[63] Continuation of Ser. No. 613,223, Nov. 15, 1990, abandoned.

[30] Foreign Application Priority Data

Nov. 17, 1989 [FR] France ..... 89 15133

[51] Int. Cl.[5] ..... A47F 5/08

[52] U.S. Cl. ..... 211/90; 108/48; 108/106; 211/187; 248/244

[58] Field of Search ..... 248/243, 244, 245, 246, 248/295.1, 231.91; 211/90, 187, 113; 108/48, 106

[56] References Cited

U.S. PATENT DOCUMENTS

| | | | |
|---|---|---|---|
| 3,990,665 | 11/1976 | Joussement | 248/243 |
| 4,095,768 | 6/1978 | Chasen | 248/290 |
| 4,685,575 | 8/1987 | Kulbersh | 211/90 |
| 4,753,405 | 6/1988 | Camilleri | 211/90 X |
| 4,919,280 | 4/1990 | Phillips | 211/187 X |

FOREIGN PATENT DOCUMENTS

| | | |
|---|---|---|
| 0004517 | 3/1979 | European Pat. Off. . |
| 1429494 | 6/1969 | Fed. Rep. of Germany . |
| 2407691 | 6/1979 | France . |
| 2458246 | 6/1979 | France . |
| 2423186 | 11/1979 | France . |
| 2627241 | 2/1988 | France . |

*Primary Examiner*—Ramon O. Ramirez
*Attorney, Agent, or Firm*—Charles E. Temko

[57] ABSTRACT

A fixing system, for removably and adjustably fixing shelves and other objects comprising, at least a first elongated element in the form of a cable or a rod. A top end and an a bottom end of said cable or rod being firmly connected to at least one support surface by anchor pieces. A plurality of object supporting fasteners each cable of being fixed at an adjustable height on a first elongated element in an intermediate region thereof, which intermediate region is tensioned in a substantially vertical direction, and kept at a distance from the support surface by at least one first spacer extending general horizontally between the supporting surface and the elongated element.

13 Claims, 4 Drawing Sheets

FIXING SYSTEM USING CABLES OR RODS

This is a continuation of application Ser. No. 07/613 223, now abandoned.

The invention relates to a fixing system for removably and adjustably fixing shelves or other objects, the system comprising at least a first elongate element in the form of a cable or a rod, with a top end thereof and a bottom end thereof being firmly connected to at least one support surface by means of respective anchor pieces, and a plurality of object-supporting fasteners each capable of being fixed at an adjustable height on a first elongate element in an intermediate region thereof, which intermediate region is tensioned in a substantially vertical direction.

BACKGROUND OF THE INVENTION

Such a system is described, for example, in FR-A-2 272 627 where the elongate elements are cables, and in FR-A-2 407 691 where the elongate elements are rods. In both of these prior systems, the elongate elements are anchored at their top and bottom ends to the ceiling and to the floor, respectively, and they extend vertically between the ceiling and the floor.

In some cases, it is desirable to avoid anchoring to the ceiling or to the floor, for example because the ceiling is not strong enough, or because the ceiling or the floor is already occupied or is too far from the location where the shelves or other objects are to be disposed.

An object of the invention is to provide a solution to this problem.

SUMMARY OF THE INVENTION

The present invention provides a system of the type defined above, in which the support surface to which at least a first one of said ends is anchored is a wall, and in which its intermediate region is kept at a distance from the wall by at least one first spacer extending generally horizontally between the wall and the elongate element, said elongate element bearing against the spacer via a zone which delimits said intermediate region and a first terminal region that extends obliquely to the corresponding anchor piece fixed to the wall. In an embodiment of the invention, a second elongate element is associated with the, or each, first elongate element, said second elongate element being tensioned substantially vertically between a top end and a bottom end to receive fasteners for the objects, a first end of the second elongate element being fixed to the first spacer between the wall and the zone where said first elongate element bears thereagainst.

One possibility is for the second end of a first elongate element to be anchored to the ceiling or to the floor, the first elongate element being held vertically between its second end and its zone bearing against the spacer.

A second possibility is for both ends of a first elongate element to be anchored to the wall, said elongate element also bearing against a second spacer projecting from the wall, the bearing zone therebetween delimiting said intermediate region and a second terminal region that extends obliquely to a corresponding anchor piece fixed to the wall.

With this second possibility, and when there is a second elongate element, each end thereof is fixed to a respective one of the spacers between the wall and the zones where the spacers against the first elongate element.

Preferably, each first elongate element is substantially situated in a vertical plane, which plane may optionally contain the second elongate element if present.

The spacers may be bars, each having one end fixed to the wall and another end serving as a bearing point for the first elongate element. The spacers may also include fixing means for fixing the elongate elements in the longitudinal direction thereof.

When the elongate elements are cables, the anchor piece(s) on the wall advantageously include swivel means enabling the direction of the cable end to be varied without exerting a bending force thereon.

For an elongate element constituted by a rod, the rod is preferably rigid and rectilinear in its intermediate region and in at least a portion of its terminal region(s), said rigid and rectilinear portions being interconnected by portions that are flexible and curved. It is also possible to provide the rods with such flexible and curved portions adjacent to the anchor pieces of the wall.

BRIEF DESCRIPTION OF THE DRAWINGS

Embodiments of the invention are described by way of example with reference to the accompanying drawings, in which.

DETAILED DESCRIPTION

Figure 1:
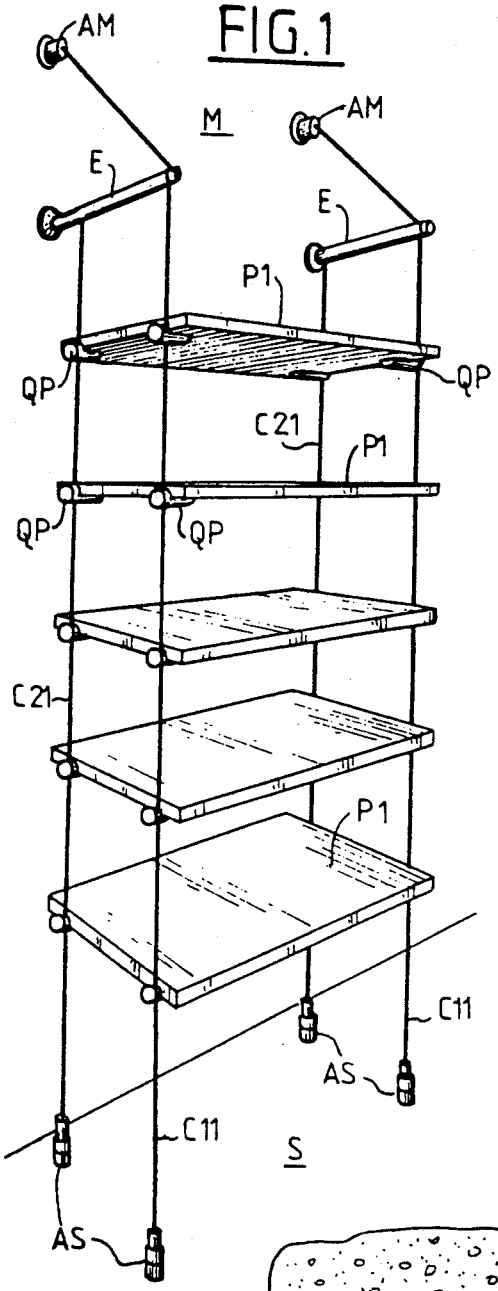
FIGS. 1, 2, and 3 are diagrammatic perspective views of systems in accordance with the invention and including cables to which shelves and other objects are fixed.

FIG. 1 shows a cable system for holding a plurality of shelves P1 in superposed positions. The system comprises two first cables C11 having their respective top ends anchored to a vertical wall M by means of anchor pieces AM and having their respective bottom ends anchored to the floor S by means of anchor pieces AS. At a level lying between the wall anchor pieces AS and the shelves P1, the cables C11 bear against the projecting ends of bars or spacers E which are fixed to the wall by their opposite ends and which extend substantially perpendicularly to the wall. Each first cable C11 extends vertically between its zone where it bears against the end of the corresponding spacer and its floor anchor piece AS, and it extends obliquely between said bearing zone and said wall anchor piece at an angle relative to the vertical which does not exceed 45°.

Two second cables C21 extend vertically downwards from points on respective ones of the two spacers E between the wall and the bearing zones of the first cables C11, the second cables extending down to the floor where their bottom ends are anchored by means of anchor pieces AS that are identical to those of the first cables C11.

The cables C11 and C21 are tensioned by means of springs included in the floor anchor pieces AS which may be as described in FR-A-2 272 627.

Each pair of cables C11–C21 lies in a vertical plane perpendicular to the wall M, with the two planes containing respective ones of the two pairs of cables being spaced apart along the wall by a distance corresponding substantially to the length of the shelves P1. Each shelf is fixed at each of its ends to the cables C11 and C12 via respective fasteners QP which are fixed removably and adjustably thereto. In the example shown, the fasteners QP are as described in FR-A-2 627 241 with reference to FIG. 4 of that document. Naturally, other types of fastener may be used, depending on the thickness of the shelves and on the material from which they are made.

Figure 2:
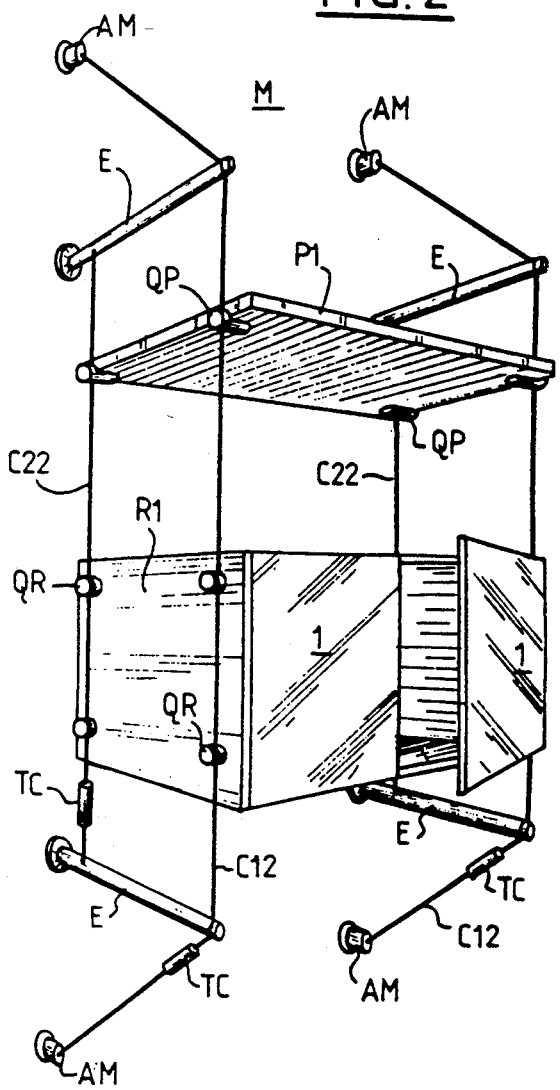

FIG. 2 shows a system supporting a shelf P1 similar to those shown in FIG. 1 together with a chest in the form of a cupboard R1 having pivoting doors 1 on its front face. This system comprises two first cables C12 having their top ends anchored to the wall M by means of anchor pieces AM similar to those shown in FIG. 1, and bearing against top spacers E which are likewise similar to those of FIG. 1. Unlike the cables C11 of FIG. 1, the bottom ends of the cables C12 are also anchored to the wall by means of anchor pieces AM similar to the top anchor pieces, and at a level between their bottom anchor pieces AM and the objects P1 and R1 that they support these cables bear against the projecting ends of bottom spacers E similar to the top spacers. Each cable C12 extends vertically between the ends of its top and bottom spacers, and between its spacers and the corresponding anchor pieces each cable C12 extends at angles relative to the vertical that do not exceed 45°.

Each of the two first cables C12 is associated with a second cable C22 tensioned vertically between the top and bottom spacers E and connected to the spacers at points that lie between the wall and the bearing zones of the first cable.

Each of the cables C12 and C22 is tensioned by a tensioner TC. The tensioners in the cables C22 are interposed between the corresponding bottom spacers and the objects P1, R1, while the tensioners in the cables C12 are interposed, in the example shown, between the bottom spacers and the bottom anchor pieces. It would also be possible to place them between the bottom spacers and the supported objects.

The shelf P1 is disposed relative to the cables in the same way as the shelves of FIG. 1, and it is fastened thereto by fasteners QP which are likewise similar to those of FIG. 1. The two pairs of cables C12–C22 pass over respective ones of the two end faces of the cupboard R1. The cupboard is connected to each of the four cables in removable and adjustable manner by corresponding pairs of fasteners QR which are superposed in the cable direction and which are as described in FR-A-2 272 627 with reference to FIGS. 4 to 6 of that document, each of said fasteners having a blind hole which receives a cylindrical stud protecting from the end face of the cupboard.

Figure 3:
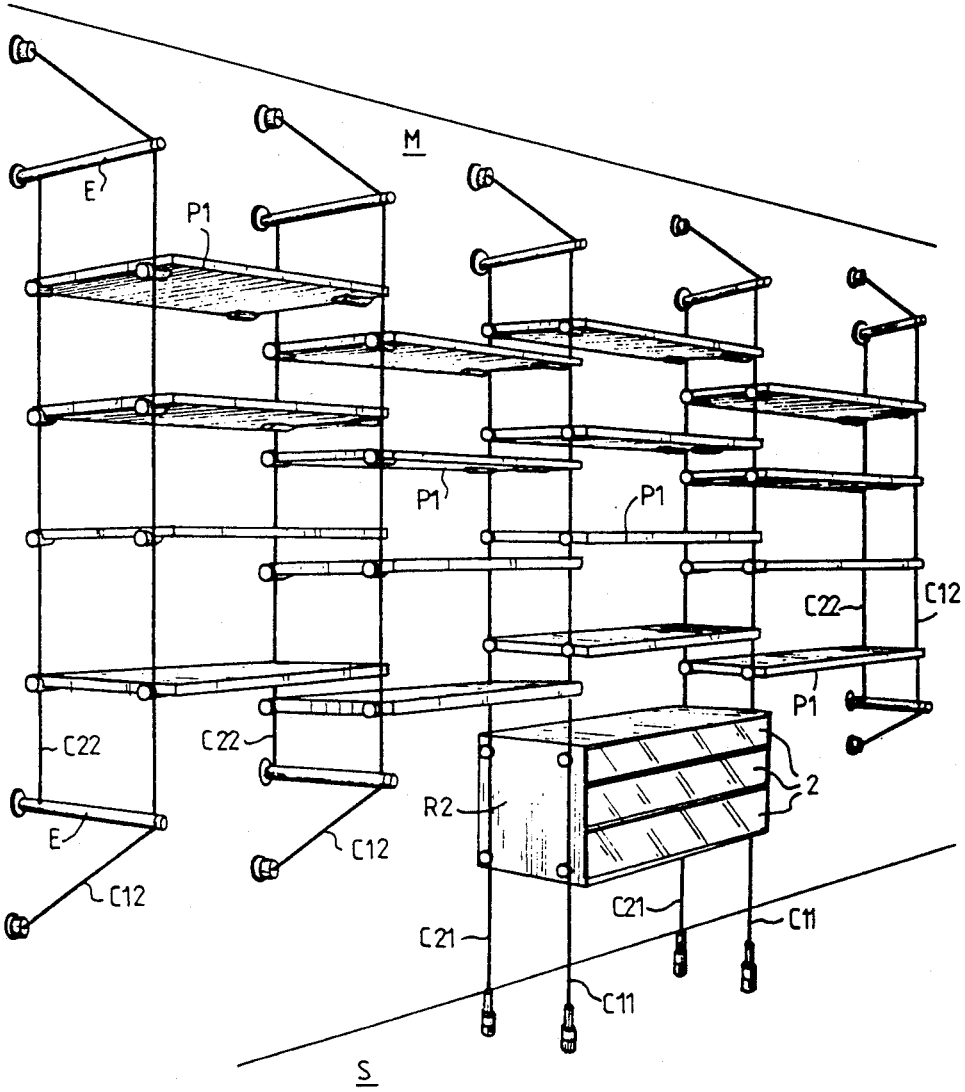

FIG. 3 shows a combined system including both cables that are anchored at their bottom ends to the floor and cables that are anchored at their bottom ends to the wall. Going from left to right, there can be seen two pairs of cables C12–C22 similar to those of FIG. 2, having top and bottom anchor pieces on the wall with associated top and bottom spacers, followed by two pairs of cables C11–C21 similar to those of FIG. 1 having top anchor pieces on the wall M with associated top spacers, and bottom anchor pieces on the floor S, and then a further pair of cables C12–C22 similar to those of FIG. 2. Between each consecutive pair of cables there is a series of superposed shelves P1 with the shelves being fastened as described above. In addition, a chest R2 of drawers 2 is mounted between the two pairs of cables C11–C21 in the manner described above with respect to the cupboard R1.

Figure 4:
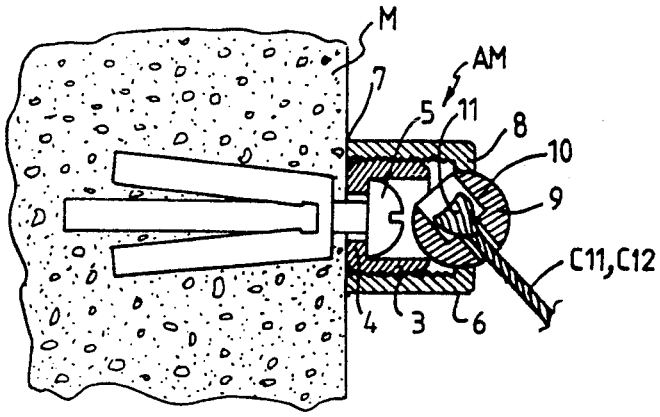
FIG. 4 is a fragmentary section view showing one end of a first cable of a system as shown in FIGS. 1 to 3 where it is anchored to the wall.

FIG. 4 shows a wall anchor piece AM together with the top end of a cable C11 or C12 fixed thereto. The anchor pieces comprises an inside cup 3 having an outside thread and a bottom with a hole therethrough, the bottom being pressed against the wall M by the head of a screw 5 which passes through the hole in the bottom 4 and which is screwed into the wall. An outside cup 6 having an inside thread is screwed onto the outside thread of the inside cup 3, with the rim 7 of the outside cup bearing against the wall while its opposite end is partially closed by a bottom wall 8 which holds a ball 9 prisoner. The cable passes through a bore 10 of varying diameter provided through the ball 9, which bore holds a flare at the end of the cable. The ball 9 swivels as a function of the direction followed by the cable in the vicinity of the anchor piece, thereby avoiding subjecting the cable to bending forces.

Figure 5:
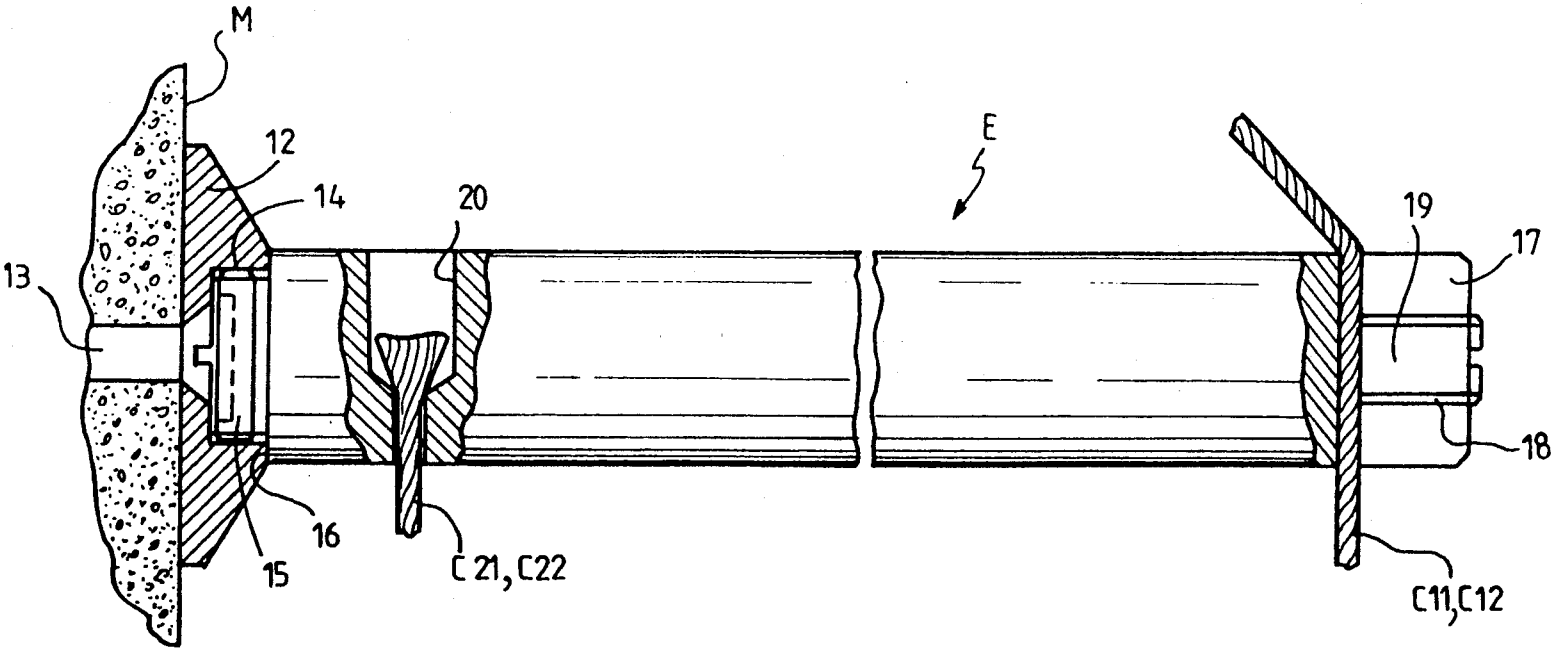
FIG. 5 is a fragmentary view of a spacer of such a system, shown partially in section on a plane containing the two cables which are fixed thereto.

As shown in FIG. 5, each spacer E is fixed to the wall M by a base 12 which is itself pressed against the wall by a screw 13 screwed into the wall. The base has a tapped hole 14 which opens out into its face facing away from the wall, and which is extended to its face in contact with the wall by a smaller-diameter hole receiving the head of the screw. The end of the spacer E directed towards the wall has a portion with an outside thread 15 for co-operating with the tapped hole 14, said portion 15 ending at a shoulder 16 which comes into abutment against the base. The opposite end of the spacer is slotted in a vertical plane perpendicular to the wall from its end face 17 down to a certain distance therefrom. A tapped hole 18 is also provided running from the end face 17 and down to the same depth as the slot, and a grub screw 19 is screwed into the hole 18 to press the cable C11 or C12 that is engaged in the slot against the bottom of the hole. The screw 19 serves to hold the cable longitudinally in position relative to the spacer, thereby making it possible to ensure that the spacer is accurately horizontal even when the wall is not completely plane and vertical.

The flared end of the cable C21 or C22 is engaged in a bore 20 of varying diameter disposed vertically through the spacer, and is held by a shoulder in the bore.

Above-described FIGS. 4 and 5 are equally applicable to top and bottom wall anchor pieces and spacers.

Figure 6:
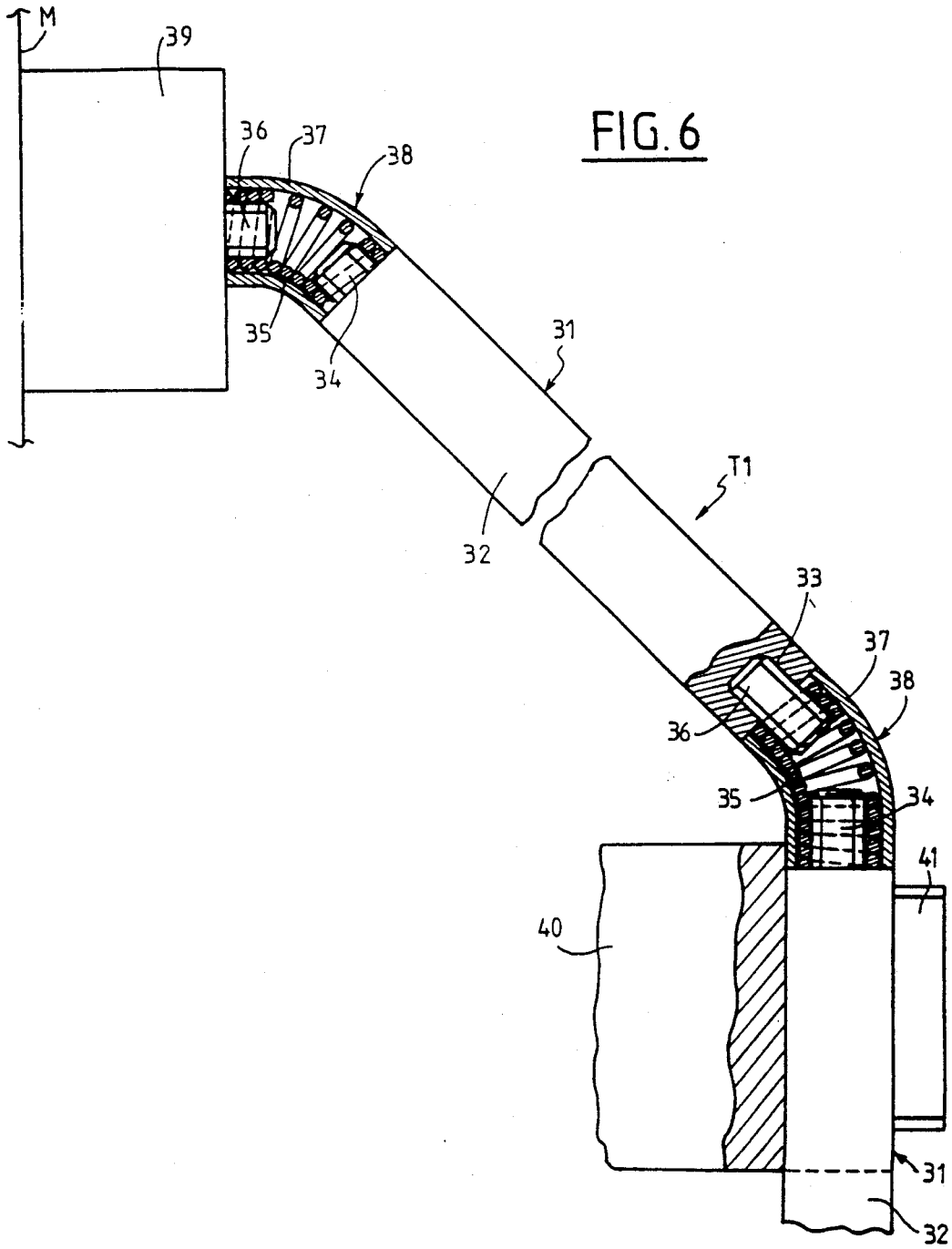
FIG. 6 is a fragmentary view, partially in section, of a system having a rod.

FIG. 6 is a fragmentary view of an elongate first element in the form of a rod, together with a portion of the corresponding spacer.

The rod T1 is made up of rigid rectilinear elements 31 and of flexible elements 38 suitable for being assembled in any order one after another. Each element 31 comprises an elongate cylindrical body 32 having an axial tapped blind hole 33 at one end and extended at its opposite end by an axial threaded stud 34. Each flexible element 32 comprises a helical spring 35 having a threaded cylindrical dowel 36 screwed into one of its ends by the turns of the spring co-operating with the dowel, which projects from the end of the spring. A flexible tubular sheath 37 e.g. made of heat-shrink plastic material is fitted over the spring 35. The outside diameter of the sheath 37 is preferably equal to the outside diameter of the body 32 of each rigid element 31, and its surface appearance should be similar thereto.

Two elements 31 or 38, or an element 31 and an element 38 can be assembled together by screwing the stud 34 or the projecting portion 36 of one of the elements into the hole 33 or into the turns of the spring 35 distant from the dowel, of the other element.

The top element of the rod T1 in FIG. 6 is constituted by a flexible element 38 whose dowel 36 is screwed into an anchor piece 39 fixed to the wall M, with the axis of the dowel 36 extending perpendicularly to the wall, and consequently extending horizontally. The anchor piece 39 may be similar to the ceiling anchor piece described in FR-A-2 407 691. The flexible terminal element is followed by one or more rigid elements 31 extending obliquely downwards, with the spring 35 of the terminal element bending elastically to take up a curved shape for connecting the horizontal direction of the axis of its dowel 36 to the oblique direction of the elements 31.

A second flexible element 38 connects the oblique rigid element(s) to another rigid element 31 extending vertically and engaged in a vertical notch at the end of a spacer 40. The free end of the spacer has a projection 41 with an outside thread projecting beyond the rod and suitable for receiving a cap (not shown) having an inside thread for pressing the rod element against the bottom of the notch and locking it in place relative to the spacer, as described in FR-A-2 423 186. The opposite end of the spacer (not shown) is fixed to the wall M, e.g. in the manner described above for the spacers E.

The rigid rod element fixed in this way to the spacer may be extended downwards by other rigid elements, with the vertical region formed in this way receiving the fasteners that may be as described in FR-A-2 423 186 or in FR-A-2 627 241, for example. This vertical region may extend down to a floor anchor piece such as that described in FR-A-2 407 691 which includes a tensioning spring. Alternatively, the rod may bear against a bottom spacer and then extend obliquely from the bottom spacer down to a bottom anchor piece on the wall similar to anchor piece 39, with the changes in direction being provided by flexible elements in the same manner as for the top portion. In this case, a spring tensioner should be interposed between two rod elements for co-operating with one of said elements in the manner described in FR-A-2 407 691 when describing the floor anchor piece, with the stud 34 or the dowel 36 of the other element being screwed into the body of the tensioner.

A second rod (not shown) made up of one or more rigid elements such as 31 is screwed by a top terminal stud 36 into a threaded hole in the spacer 40. The bottom end of the second rod may be anchored to the floor in the same manner as the first rod, or it may be fixed to the bottom spaced by screwing an end tapped hole 33 onto a threaded stud on the spacer, or by co-operation between a dowel such as 36 with the same tapped hole 33 and with a tapped hole in the bottom spacer, which can then be identical to the top spacer 40.

Naturally, the positions of the elements 31 and 38 constituting the rods may be reversed with the studs 34 and the dowels 36 projecting downwards instead of upwards.

The invention is not limited to the embodiments described and shown. In particular, the system of the invention may include first cables or first rods that are anchored at their top ends to the ceiling and at their bottom ends to the wall, possibly in combination with cables or rods that are anchored to the wall and to the floor and/or with cables or rods that are anchored to the wall only, as described in the examples. Regardless of which anchor mode is used, the system is equally suitable for receiving shelves, cupboards, chests of drawers, and all sorts of other objects fitted thereto by appropriate fasteners, and particularly, but not exclusively by fasteners as described in FR-A-2 627 241.

I claim:

1. A fixing system for fixing objects in removable and adjustable manner, the system comprising at least one first elongate element in the form of a cable or a rod, with a top end thereof and a bottom end thereof being firmly connected to at least one support surface by means of respective anchor pieces, and a plurality of object-supporting fasteners each capable of being fixed at adjustable height on a first elongate element in an intermediate region thereof, which intermediate region is tensioned in a substantially vertical direction, wherein the support surface to which at least a first one of said ends is anchored is a wall, and under tension, and wherein its intermediate region is kept at a distance from the wall by at least one first spacer extending generally horizontally between the wall and the elongate element, said elongate element bearing against the spacer via a zone which delimits said intermediate region and a first terminal region that extends obliquely to the corresponding anchor piece fixed to the wall.

2. A system according to claim 1, wherein a second elongate element is associated with the, or each, first elongate element, said second elongate element being tensioned substantially vertically between a top end and a bottom end to receive fasteners for the objects, a first end of the second elongate element being fixed to the first spacer between the wall and the zone where said first elongate element bears thereagainst.

3. A system according to claim 1, wherein the second end of the first elongate element and the second end of any second elongate element associated therewith is anchored to the ceiling or to the floor, with the first elongate element being tensioned vertically between its second end and its zone where it bears against the spacer as a result of engagement with said spacer.

4. A system according to claim 1, wherein both ends of a first elongate element are anchored to the wall, said elongate element further bearing against a second spacer projecting from the wall, the bearing zone therebetween delimiting said intermediate region and a second terminal region that extends obliquely to the corresponding anchor piece fixed to the wall.

5. A system according to claim 2, wherein both ends of a first elongate element are anchored to the wall, said elongate element further bearing against a second spacer projecting from the wall, the bearing zone therebetween delimiting said intermediate region and a second terminal region that extends obliquely to the corresponding anchor piece fixed to the wall, and wherein both ends of a second elongate element are fixed to respective ones of the spacers against which the associated first elongate element bears, being fixed thereto between the wall and the bearing zones between said spacers and the first elongate element.

6. A system according to claim 1, wherein each first elongate element is situated substantially in a vertical plane.

7. A system according to claim 2, wherein each first elongate element and the associated second elongate element are situated substantially in a vertical plane.

8. A system according to claim 5, wherein each first elongate element and the associated second elongate element are situated substantially in a vertical plane.

9. A system according to claim 1, wherein the spacers are bars each having one end fixed to the wall and another end against which a first elongate element bears under tension.

10. A system according to claim 1, wherein the spacers include means for locking the elongate elements against relative displacement in the longitudinal direction of the elongate elements. pg,13

11. A system according to claim 1, wherein the elongate elements are cables and wherein the, or each, wall anchor piece includes swivel means enabling the direction of the cable end to be varied without exerting a bending force thereon.

12. A system according to claim 1, wherein the elongate elements are rods which are rigid and rectilinear in their intermediate region and at least in portions of their terminal regions, said rigid and rectilinear portions being interconnected by flexible and curved portions.

13. A system according to claim 12, wherein the rods further include flexible and curved portions adjacent to the wall anchor pieces.

* * * * *